US007124695B2

(12) United States Patent
Buechler

(10) Patent No.: US 7,124,695 B2
(45) Date of Patent: Oct. 24, 2006

(54) MODULAR SHELVING SYSTEM

(76) Inventor: James G. Buechler, 110 Deer Lake Dr., Bloomfield, IN (US) 47424

( * ) Notice: Subject to any disclaimer, the term of this patent is extended or adjusted under 35 U.S.C. 154(b) by 229 days.

(21) Appl. No.: 10/644,182

(22) Filed: Aug. 20, 2003

(65) Prior Publication Data

US 2005/0039646 A1 Feb. 24, 2005

(51) Int. Cl.
*A47B 47/00* (2006.01)

(52) U.S. Cl. ..... 108/180; 108/158.12

(58) Field of Classification Search ..... 108/180, 108/185, 186, 187, 190, 143, 153.1, 155, 108/157.18, 158.12; 312/257.1, 265.1, 265.2, 312/195; 248/186, 188.1
See application file for complete search history.

(56) References Cited

U.S. PATENT DOCUMENTS 1,393,679 A * 10/1921 Forster ..... 108/158.12
1,538,393 A 5/1925 Fowler
1,687,671 A * 10/1928 June ..... 108/186
2,915,831 A 12/1959 Parker
RE28,244 E * 11/1974 Evans ..... 108/157.13
4,127,072 A 11/1978 LePon
4,616,757 A 10/1986 Hobson
4,635,564 A 1/1987 Baxter
4,685,576 A 8/1987 Hobson
4,709,640 A 12/1987 Jouanin
4,765,253 A * 8/1988 Schappach ..... 108/158.12
5,048,429 A 9/1991 Freiberg
5,363,775 A * 11/1994 Simpson ..... 108/187
5,417,307 A * 5/1995 McIntyre et al. ..... 182/181.1
5,735,221 A * 4/1998 Benayon ..... 108/107
5,743,413 A 4/1998 Noll
5,813,737 A 9/1998 Stone
6,086,172 A 7/2000 Lee
D439,443 S 3/2001 Nadon
6,619,601 B1 * 9/2003 Vall ..... 248/188

* cited by examiner

*Primary Examiner*—Jose V. Chen
(74) *Attorney, Agent, or Firm*—John R. Hoffman

(57) ABSTRACT

A modular shelving system includes a plurality of modular upright support units spaced from each other in the length direction of the system. Each unit includes a plurality of generally horizontal through passages for receiving and respectively supporting a plurality of elongated shelf-supporting rails of varying lengths to allow for varying the length of the shelving system as well as varying the spacing between the support units. Some of the through passages are located at lower areas of the support units to position some of the supporting rails for supporting an appropriate lower shelf. Other of the through passages are located at upper areas of the support units to position other of the supporting rails for supporting an appropriate upper shelf.

8 Claims, 6 Drawing Sheets

MODULAR SHELVING SYSTEM

FIELD OF THE INVENTION

This invention generally relates to the art of shelving assemblies used for storage or continuous use purposes and, particularly, to a modular shelving system which can be adjusted or varied to change the overall length of the shelving or to vary the loading characteristics of the shelving without changing the main support components thereof.

BACKGROUND OF THE INVENTION

Shelving assemblies are available in a wide variety of configurations for purchase by the ultimate consumer as well as by construction or design contractors to meet a multitude of storage and/or continuous use requirements. Such shelving assemblies often are break-down systems and typically are available to the consumer at home improvement centers, "lumber" stores or the like.

One of the problems with most shelving assemblies or systems is that any given shelving "package" has given dimensions. When designing a shelving layout, the space to be occupied by the shelving most likely has fixed dimensions. For instance, it may be desirable to install shelves along a ten foot wall. If the shelving assemblies are available in three foot lengths, three units would be used, leaving a one foot "lost" space which not only is aesthetically displeasing but lacks ulitarian efficiency. In order to avoid these types of situations, some shelving systems come in different lengths for a more custom approach. Unfortunately, this is not cost effective both from manufacturing as well as inventory considerations.

Another problem with most currently available shelving assemblies or systems is that they are designed to carry a specific load or limitation. Typically, the load limitations are built into the shelving at a relatively high parameter to meet the maximum needs of most consumers. Unfortunately, shelving often is used under situations where these maximum load limitations are not at all necessary. Consequently, expensive high-load shelving often is used when much cheaper shelving would be quite adequate.

The present invention is directed to solving these and other problems in currently available shelving assemblies or systems, wherein the overall length of a shelving system can be easily varied and/or the loading characteristics of the shelving can be varied lengthwise of the system without changing the design or construction of the support units for the shelving.

SUMMARY OF THE INVENTION

An object, therefore, of the invention is to provide a new and improved modular shelving system of the character described.

As is typical, the shelving system has a major length direction and a minor width direction. In the exemplary embodiment of the invention, a plurality of modular upright support units are provided for spacing from each other in the length direction of the system. Each unit includes a plurality of generally horizontal through passages for receiving and respectively supporting a plurality of elongated shelf-supporting rails of varying lengths to allow for varying the length of the shelving system as well as varying the spacing between the support units. Some of the through passages are located at lower areas of the support units to position some of the supporting rails for supporting an appropriate lower shelf. Other of the through passages are located at upper areas of the support units to position other of the supporting rails for supporting an appropriate upper shelf.

According to one aspect of the invention, each modular upright support unit includes a front upright post and a rear upright post joined by an upper cross brace and a lower cross brace. The upper and lower cross braces are aligned with respective pairs of upper and lower through passages in the front and rear upright posts. The lower through passages are completely enclosed passages. The upper through passages are located at the tops of the upright posts and are in the form of open notches.

According to another aspect of the invention, each upright post of each modular upright support unit is vertically split on a line intersecting the through passages to form a pair of post parts which are separable to effectively open the through passages. This allows the cross braces to be connected to one of the post parts by appropriate fasteners inserted through the one post part from within the through passages.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
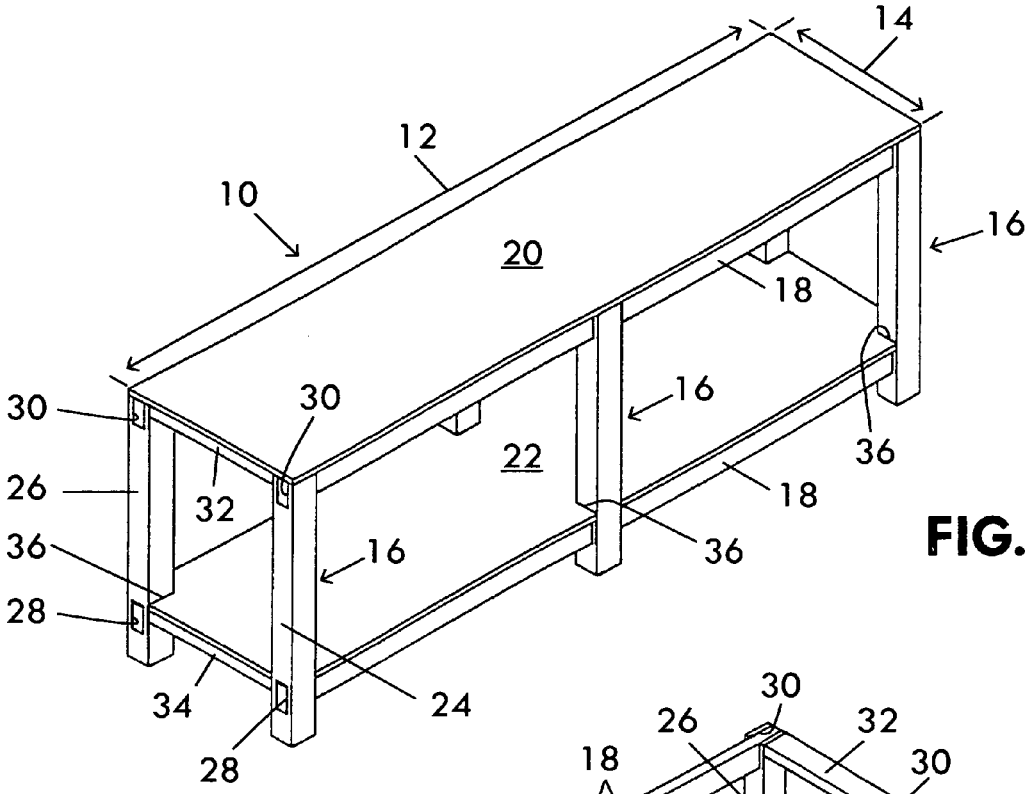
FIG. 1 is a perspective view of a modular shelving assembly or system incorporating three modular upright support units according to the invention.
Figure 2:
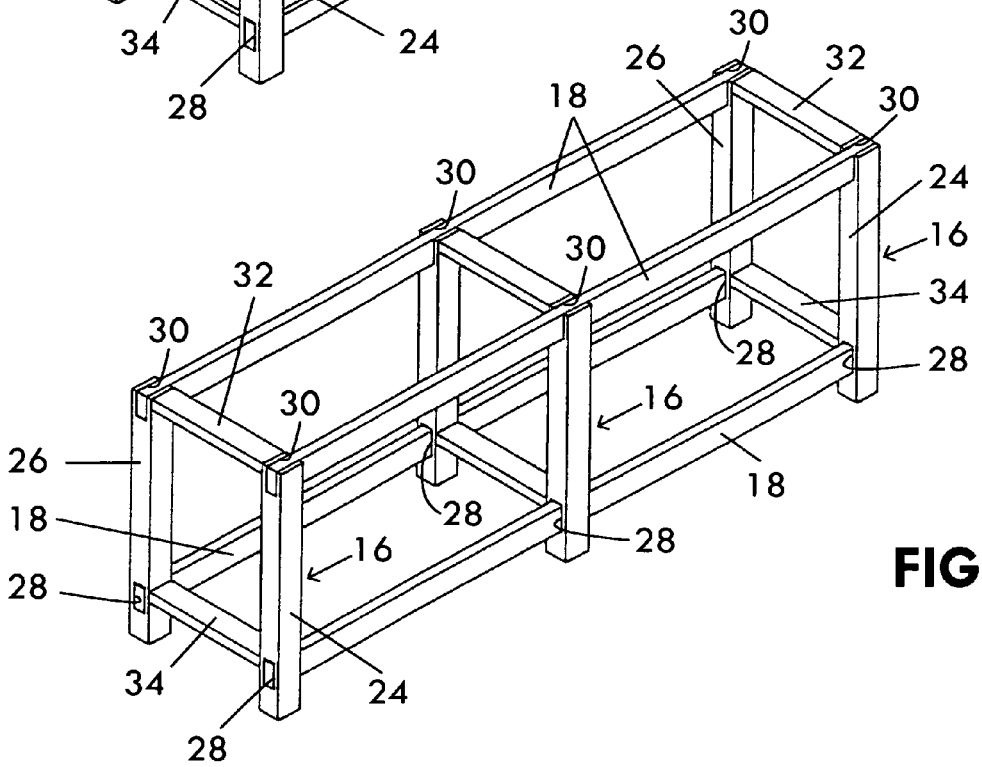
FIG. 2 is a view similar to that of FIG. 1, with the shelves removed to facilitate an illustration of the shelf-supporting rails assembled to the modular upright support units.

Referring to the drawings in greater detail, and first to FIGS. 1 and 2, the invention is embodied in a modular shelving system, generally designated 10, which, as is typical with most shelving assemblies, has a major length dimension 12 and a minor width dimension 14. The invention is incorporated primarily in a plurality of modular upright support units, generally designated 16, which are spaced from each other in the length direction 12 of the system. Generally, the upright support units are used to receive and support a plurality of elongated shelf-supporting rails 18 which, in turn, combine with the upright support units to support upper and lower planar shelves 20 and 22, respectively.

From a practical aspect, shelf-supporting rails 18 typically would comprise 2×4's, and planar shelves 20 and 22 would comprise custom cut sheets of plywood of a desired thickness. Modular upright support units 16 typically would be marketed in a package of a plurality of units, such as two, three, four or more units. In the shelving system 10 of FIGS. 1 and 2, three modular upright support units 16 obviously are used, with one unit at each opposite end of the system and a third unit at the center of the length direction 12 of the system.

Before proceeding to describing the details of each modular upright support unit 16, reference will be made to FIGS. 3–5 to show the unique utility of the units.

Figure 3:
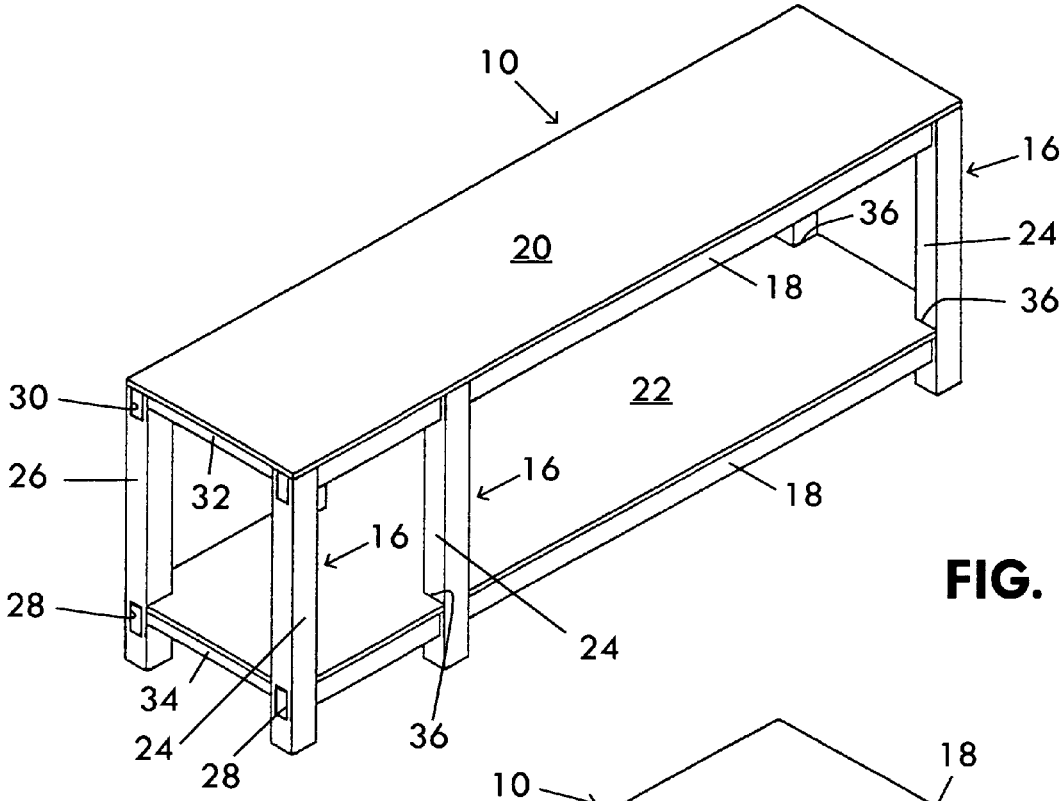
FIG. 3 is a view similar to that of FIG. 1, but showing the center upright support unit moved to the left of the assembly to shift the load bearing characteristics of the system to one end thereof.

In particular, FIG. 3 shows modular shelving system 10 of FIG. 1 modified to change or vary the loading characteristics of the system. In other words, with the middle upright support unit 16 in FIG. 1 being positioned at the center of the length direction 12 of the system, the load bearing characteristics of the system are spread fairly uniform along the length thereof. However, if a consumer wishes to support a rather heavy item, such as an electrical generator or the like, the middle upright support unit 16 may be moved along the length direction of the system, such as to one end thereof as seen in FIG. 3. The heavy generator can be supported by the more closely spaced support units 16 at the left-hand end of the system as shown in FIG. 3, and lighter items can be supported by the system toward the right-hand end of the length direction. This has been accomplished without changing a single item of the entire system, except for the notching of lower shelf 22 as will be seen hereinafter. Otherwise, modular upright support units 16 are identical in both systems of FIGS. 1 and 3, and the shelf-supporting rails (or 2×4's) 18 also remain the same.

Figure 4:
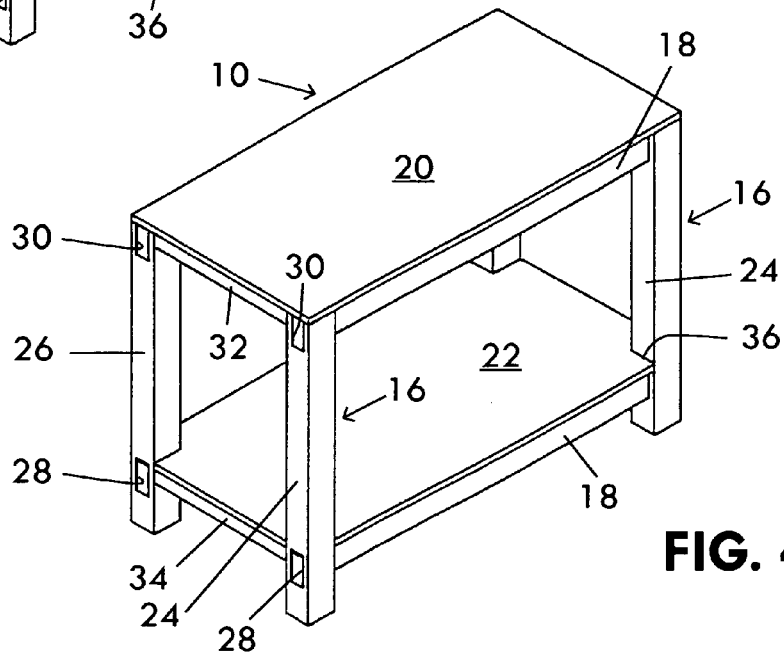
FIG. 4 is a perspective view of a shelving system using only two modular upright support units according to the invention.
Figure 5:
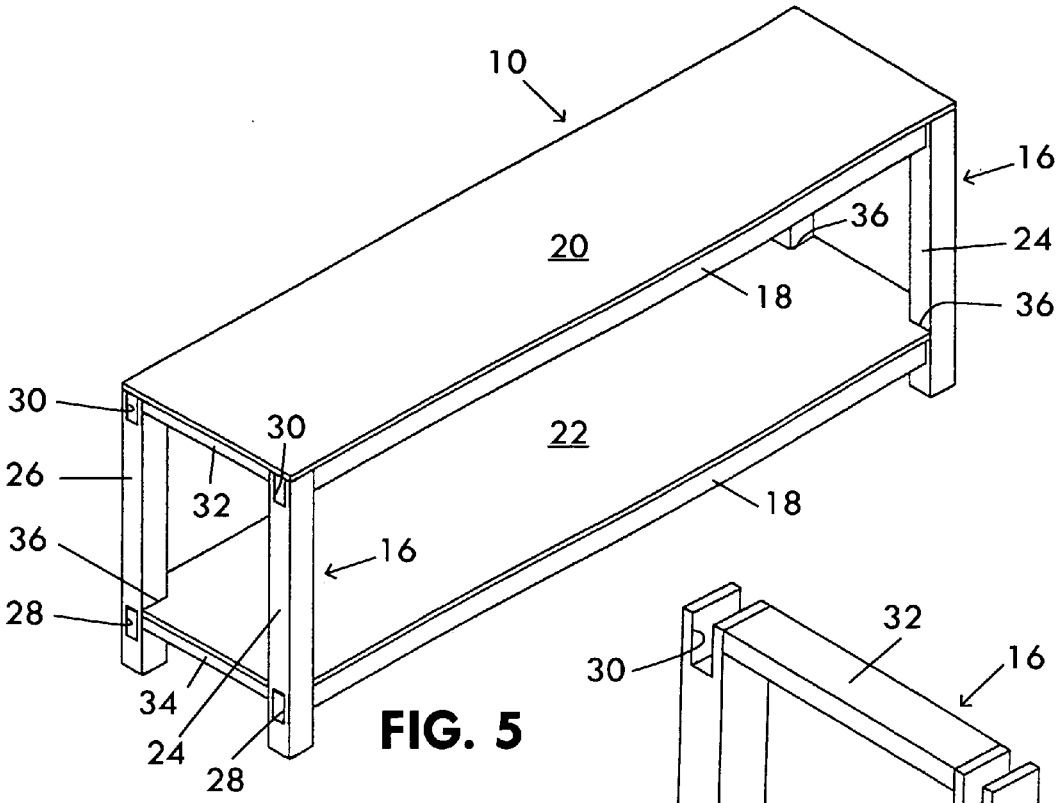
FIG. 5 is a view similar to that of FIG. 4, but showing the two modular upright support units spaced further apart from each other to provide a longer shelving system.

FIGS. 4 and 5 simply show that a pair of modular upright support units 16 can be used to form modular shelf units of practically an infinitely varying length, limited only by the length of the shelf-supporting rails (or 2×4's) 18. FIG. 4 shows a modular shelving system which may be four feet in length, for instance, whereas the system in FIG. 5 may be eight feet in length, for instance. Modular upright support units 16 remain the same in both systems, and shelf-supporting rails 18 and planar shelves 20 and 22 simply are cut to size.

Therefore, FIGS. 3–5 show that the common or identically constructed modular upright support units 16 allow for varying the overall length of the shelving system as well as varying the spacing between the support units to change the load bearing characteristics of the system.

Figure 6:
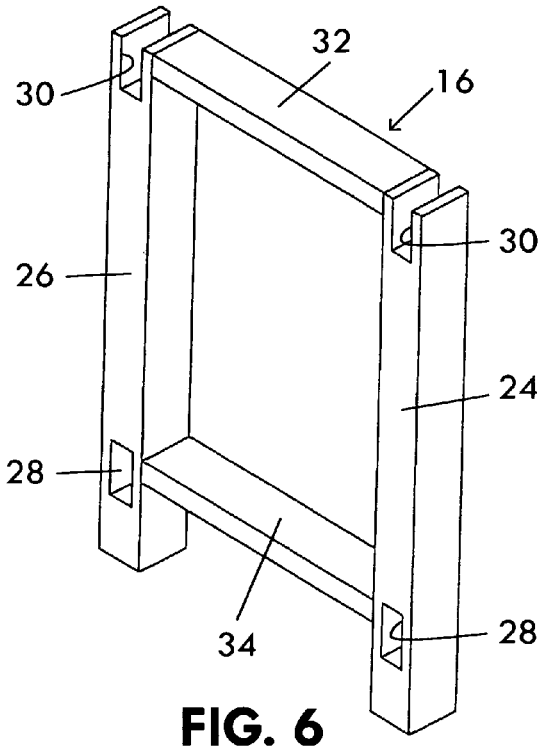
FIG. 6 is a perspective view, on an enlarged scale, of a single modular upright support unit according to the invention.

FIG. 6 shows an enlarged depiction of one of the common modular upright support units 16. Specifically, each unit includes a pair of upright posts 24 and 26 which are spaced from each other in the minor width direction 14 (FIG. 1) of the modular shelving system 10. Therefore, upright post 24 can be considered the front upright post, and post 26 can be considered the rear upright post. Each post includes a lower through passage 28 which is completely enclosed, along with an upper through passage 30 which is in the form of an open notch at the top of the post. The posts are spaced from each other and joined to each other by an upper and a lower cross brace 32 and 34, respectively. It can be seen that the cross braces are aligned with the through passages. In other words, upper cross brace 32 is aligned with upper through passages or notches 30, and lower cross brace 34 is aligned with lower through passages 28. Upright posts 24 and 26 and cross braces 32 and 34 may be fabricated of dimensioned wood or from plastic material, or the entire upright support unit 16 may be molded in one-piece of plastic material.

In assembly, two or more modular upright support units 16 as described in relation to FIG. 6, are provided as shown in FIG. 2. A pair of lower shelf-supporting rails (or 2×4's) 18 are inserted through lower through passages 28 as seen in FIG. 2. Of course, as described above in relation to FIG. 3, the center upright support unit 16 can be positioned at any location between the end-most support units 16 whether it be at the center of the system as shown in FIG. 2 or closer to one end of the system as shown in FIG. 3. The upper shelf-supporting rails (or 2×4's) 18 then are simply lowered into the upper through passages or notches 30 at the tops of upright posts 24 and 26 of the respective upright support units 16. The rails can be fixed in place by appropriate fasteners or an adhesive, or simply by a press-fit. Bottom shelf 22 then is cut with notches 36 (FIG. 1) and lowered into position on top of the lower 2×4's 18 and on top of lower cross braces 34 of the upright support units. The lower shelf can be fixed in place by appropriate fasteners or an adhesive, if desired. Finally, upper shelf 20 is cut to size and is simply positioned on top of the upper 2×4's 18, as well as on top of upper cross braces 32 and the very tops of the modular upright support units 16. The top shelf can be fixed in position by appropriate fasteners or an adhesive, if desired.

Figure 7:
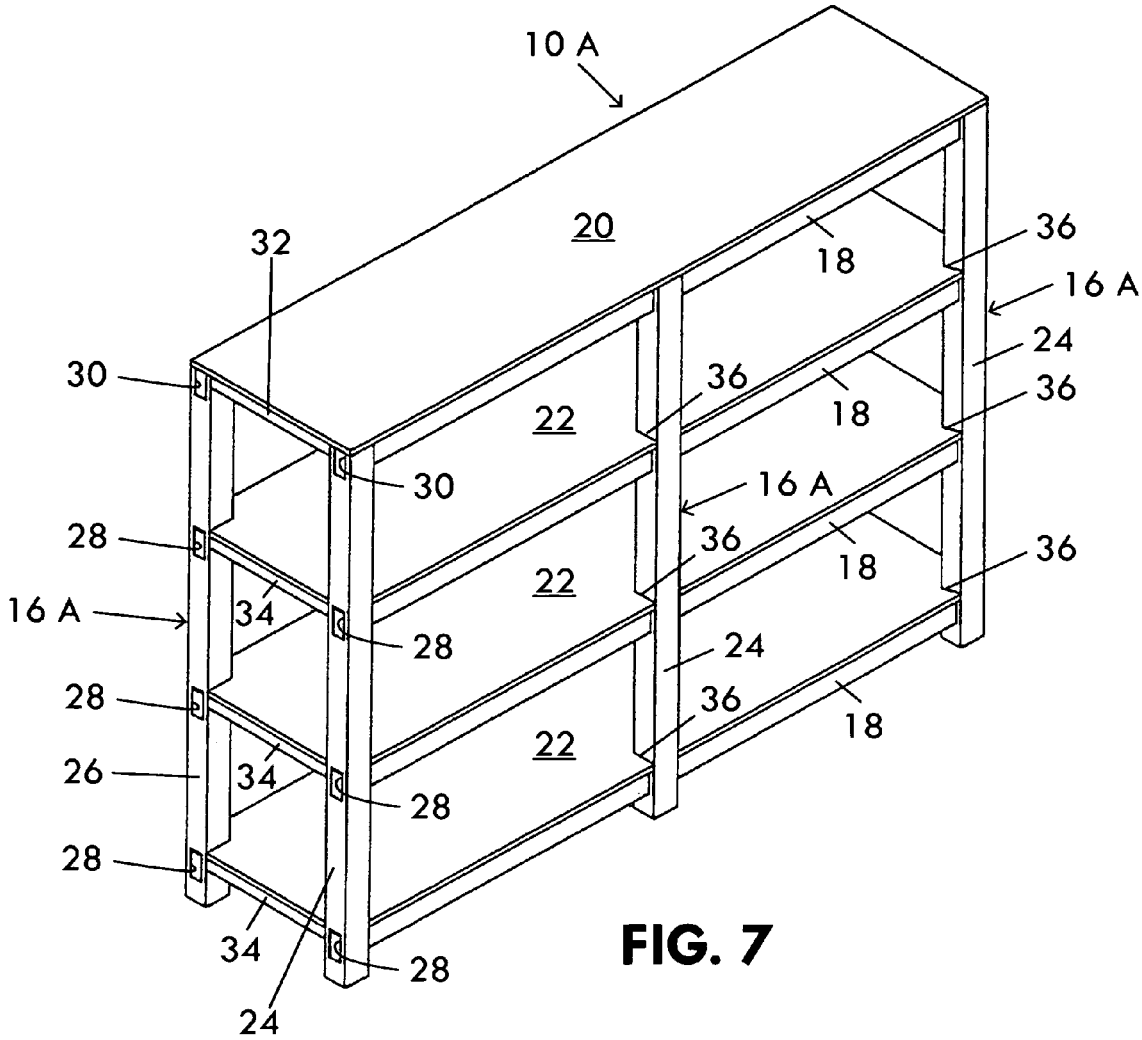
FIG. 7 is a perspective view of a modular shelving system similar to that of FIG. 1, but showing that the system can be designed for supporting more than two shelves, as desired.

FIG. 7 simply shows that more than two shelves can be formed into a modular shelving system, generally designated 10A, by providing a plurality of modular upright support units, generally designated 16A, which are provided with additional "layers" of through passages 28 for receiving additional shelf-supporting rails (or 2×4's) 18. This simple modification allows for stacking of additional shelves 22 along with a top shelf 20. The construction of modular upright support units 16A and the assembly of modular shelving system 10A is similar to that described above for the two-shelf system 10.

The fabrication of each modular upright support unit 16 now will be described. Referring back to FIG. 6 and the detailed description of the support unit, above, cross braces 32 and 34 can be secured to the insides of upright posts 24 and 26 by appropriate adhesives or by "toe-nailing" appropriate fasteners such as nails, brads, screws or the like from the cross braces into the upright posts.

Figure 8:
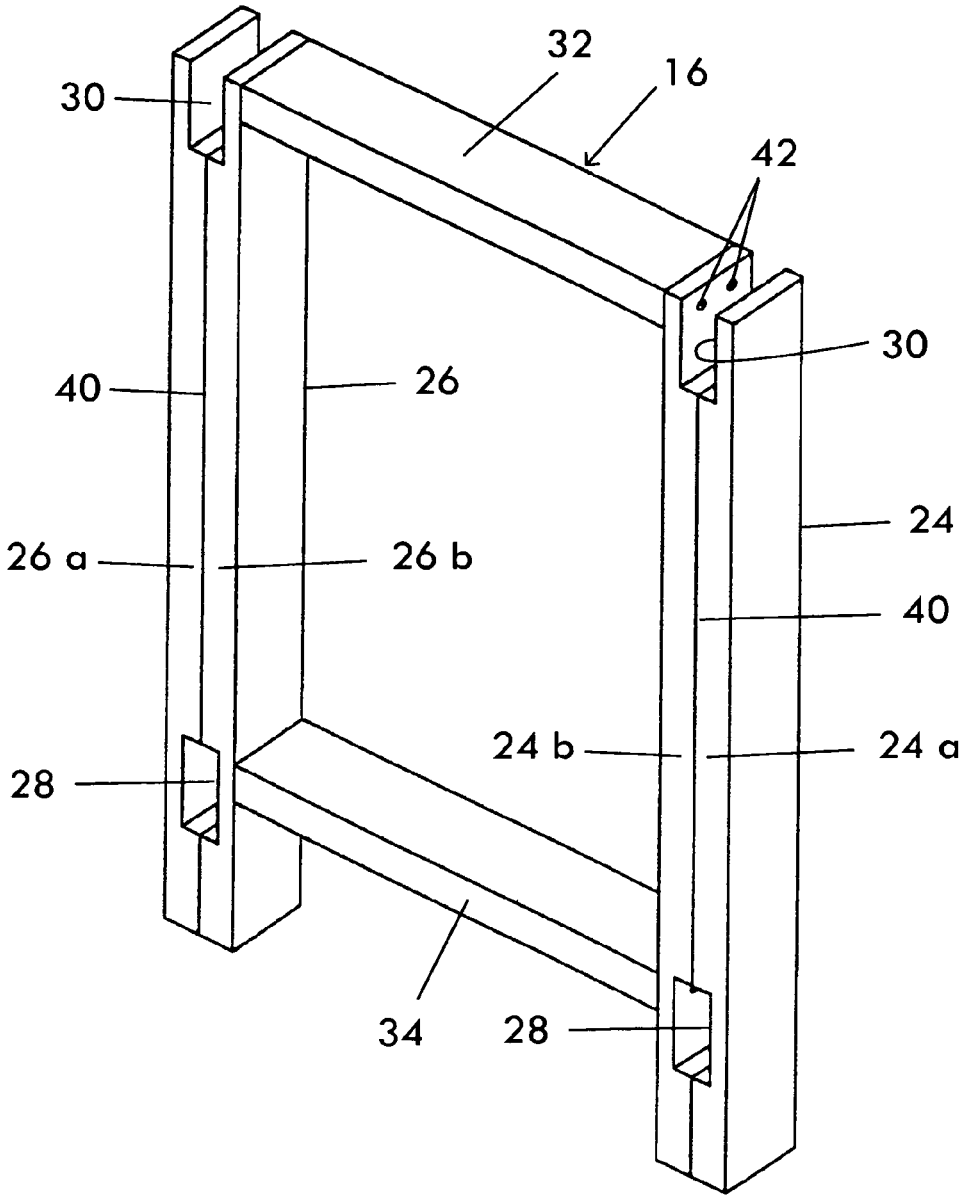
FIG. 8 is a view similar to that of FIG. 6, but showing a modified embodiment of the modular upright support unit.
Figure 9:
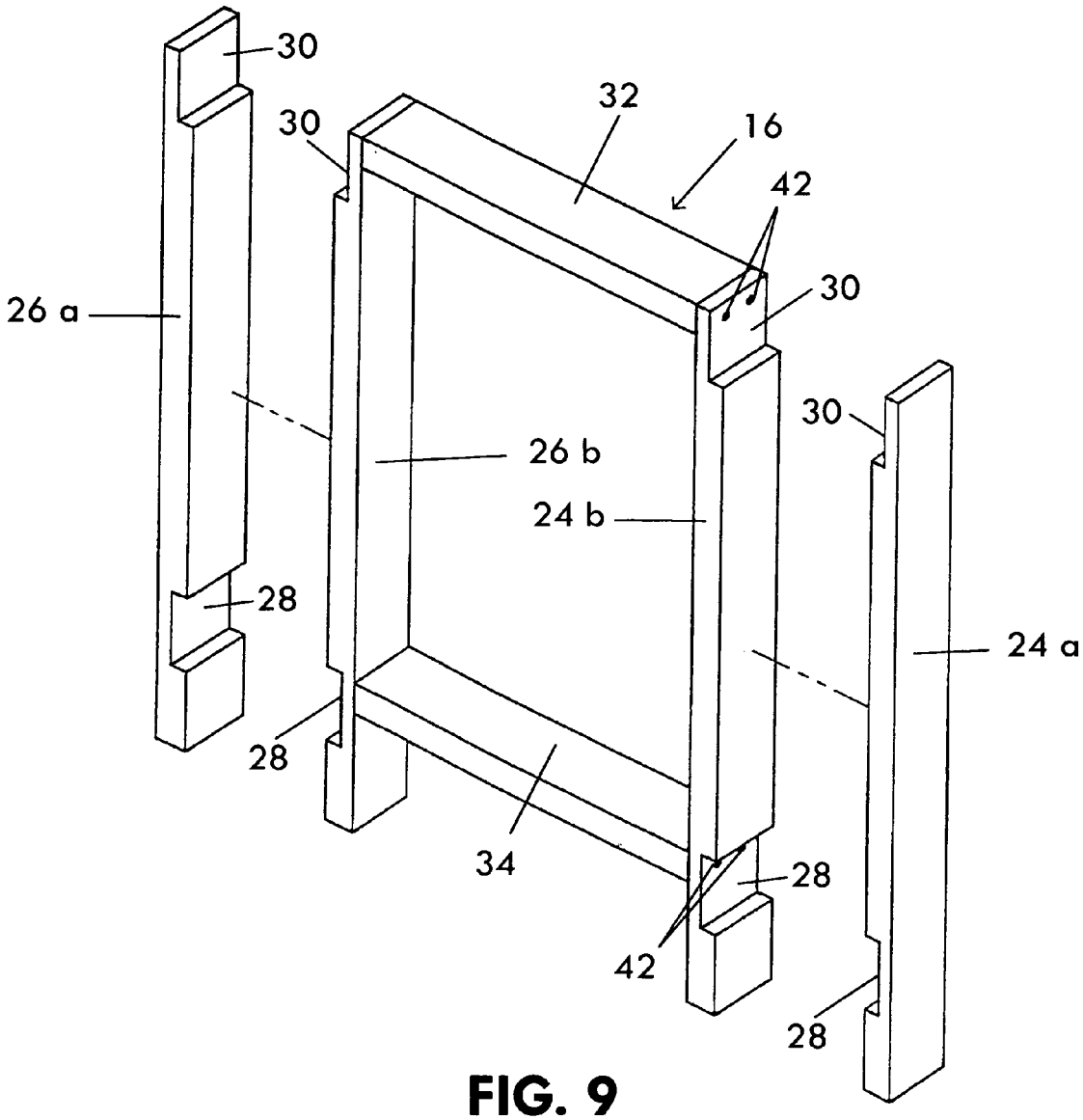
FIG. 9 is an exploded perspective view showing the parts of the upright posts separated to allow for assembling and securing the cross braces in place.

However, FIGS. 8 and 9 show a unique system wherein upright posts 24 and 26 are vertically split on a line 40 intersecting through passages 28 and 30 to form a pair of post parts 24*a*/24*b* and 26*a*/26*b*. Post parts 24*a* and 26*a* can be considered the outside post parts, and post parts 24*b* and 26*b* can be considered the inside post parts.

FIG. 9 shows the outside post parts 24*a* and 26*a* separated or moved away from inside post parts 24*b* and 26*b*, respectively. This effectively opens through passages 28 and 30. Cross braces 32 and 34 which are aligned with through passages 30 and 28, respectively, then are secured to the inside surfaces of inside post parts 24*b* and 26*b* by appropriate fasteners, such as screws 42, at locations inside the through passages. Once the cross braces are securely fixed, outside post parts 24*a* and 26*a* are secured to the inside post parts 24*b* and 26*b*, respectively, as shown in FIG. 8. The post parts can be secured together by appropriate adhesives or additional fasteners (not shown), as desired.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A modular shelving system having a major length direction and a minor width direction, comprising:

a plurality of modular upright support units to be spaced from each other in said length direction and including a pair of end support units and at least one intermediate support unit between the end units, each unit including a plurality of generally horizontal through passages for receiving and respectively supporting a plurality of elongated shelf-supporting rails of varying lengths to allow for varying the length of the shelving system as well as varying the spacing between the support units, some of the through passages being located at lower areas of the support units to position some of the supporting rails for supporting an appropriate lower shelf, and other of the through passages being located at upper areas of the support units to position other of the supporting rails for supporting an appropriate upper shelf, whereby the intermediate support unit can be selectively moved toward either end support unit to accommodate different loads along the length of the shelving, each of said modular upright support units including at least one outside upright post connected to a generally horizontal inside cross brace at a point aligned with one of said through passages, the upright post being vertically split on a line intersecting the through passage to form a pair of post parts which are separable to effectively open the through passage and, thereby, allow the cross brace to be connected to one of the post parts by an appropriate fastener inserted through the one post part from within the through passage.

2. The modular shelving system of claim 1 wherein each of said modular upright support units includes a front upright post and a rear upright post joined by cross brace means.

3. The modular shelving system of claim 2 wherein said cross brace means include an upper cross brace and a lower cross brace.

4. The modular shelving system of claim 3 wherein said upper and lower cross braces are aligned with respective pairs of upper and lower through passages in the front and rear upright posts.

5. The modular shelving system of claim 1 wherein said some of the through passages located at lower areas of the support units are completely enclosed through passages.

6. The modular shelving system of claim 1 wherein said other of the through passages located at upper areas of the support units are open notches near the tops of the support units.

7. A modular shelving system having a major length direction and a minor width direction, comprising:

a plurality of modular upright support units to be spaced from each other in said length direction and including a pair of end support units and at least one intermediate support unit between the end units, each unit including a front upright post and a rear upright post, each upright post having an upper through passage and a lower through passage, the lower through passages being completely enclosed passages and the upper through passages being open notches at the tops of the upright posts;

upper and lower cross braces joining the front and rear upright posts, the upper and lower cross braces being aligned with the upper and lower through passages, respectively, in the front and rear upright posts;

whereby the through passages can receive and respectively support a plurality of elongated shelf-supporting rails of varying lengths to allow for varying the length of the shelving system as well as varying the spacing between the support units, the lower through passages thereby receiving lower rails for supporting an appropriate lower shelf and the upper through passages receiving upper rails for supporting an appropriate upper shelf;

whereby the intermediate support unit can be selectively moved toward either end support unit to accommodate different loads along the length of the shelving; and each of said modular upright support units including at least one outside upright post connected to a generally horizontal inside cross brace at a point aligned with one of said through passages, the upright post being vertically split on a line intersecting the through passage to form a pair of post parts which are separable to effectively open the through passage and, thereby, allow the cross brace to be connected to one of the post parts by an appropriate fastener inserted through the one post part from within the through passage.

8. The modular shelving system of claim 7 wherein said upper and lower cross braces are aligned with respective pairs of upper and lower through passages in the front and rear upright posts.

* * * * *